US005496639A

United States Patent [19]

Connell et al.

[11] Patent Number: 5,496,639

[45] Date of Patent: Mar. 5, 1996

[54] POLY(ARYLENE ETHER IMIDAZOLE) SURFACING FILMS FOR FLAT AND PARABOLIC STRUCTURES

[75] Inventors: John W. Connell, Yorktown; Timothy W. Towell, Hampton; Stephen S. Tompkins, Williamsburg, all of Va.

[73] Assignee: The United States of America as represented by the Administrator of the National Aeronautics and Space Administration, Washington, D.C.

[21] Appl. No.: 238,102

[22] Filed: May 4, 1994

[51] Int. Cl.[6] ..... H01Q 15/14

[52] U.S. Cl. ..... 428/413; 428/473.5; 343/897; 343/912

[58] Field of Search ..... 343/897, 912; 428/413, 473.5

[56] References Cited

U.S. PATENT DOCUMENTS 4,066,625 1/1978 Bolger ..... 528/94

4,635,071 1/1987 Gounder et al. ..... 343/897

5,116,934 5/1992 Connell et al. ..... 528/125

5,370,921 12/1994 Cedarleaf ..... 428/138

*Primary Examiner*—Frederick Krass

*Attorney, Agent, or Firm*—George F. Helfrich; Joy L. Bryant

[57] ABSTRACT

Films of thermoplastic poly(arylene ether imidazole)s (PAEI)s are used as surface modifiers for neat resin panels and composite resin panels. The PAEI polymer contains imidazole groups along the backbone which co-cure, i.e., react chemically, with epoxies or bismaleimides during processing and thereby provide excellent adhesion between the PAEI film and an epoxy or bismaleimide neat resin or composite resin facesheet. The film provides good adhesion and a smooth surface to the finished part and acts as a release agent from the mold. The as-processed integral structures have very smooth (specular) surfaces, and since the film releases readily from a glass mold, no release agent is necessary. The PAEI film is thermally stable, resistant to electron radiation, and adheres tenaciously to the facesheet. The film maintains good adhesion even after thermal cycling from room temperature to ~ −196° C.

5 Claims, 2 Drawing Sheets

POLY(ARYLENE ETHER IMIDAZOLE) SURFACING FILMS FOR FLAT AND PARABOLIC STRUCTURES

ORIGIN OF INVENTION

The invention described herein was made by employees of the United States Government and may be manufactured and used by or for the Government for government purposes without the payment of any royalties thereon or thereof.

BACKGROUND OF INVENTION

1. Field of the Invention

This invention relates generally to structures made from neat resins and composites. It relates particularly to neat resin and composite structures comprising poly(arylene ether imidazole), PAEI, surfacing films chemically bonded to epoxy or bismaleimide, as well as graphite/epoxy or graphite/bismaleimide face sheets.

2. Description of the Related Art

PAEIs are aromatic polymers which possess high glass transition temperatures and high mechanical properties. They are prepared from bis(hydroxyimidazole) monomers and activated aromatic dihalides or dinitro compounds under conditions described in J. W. Connell and P. M. Hergenrother, *High Performance Polymers*, Vol. 2, No. 4, 211–221, 1990, *Journal of Polymer Science Part A: Polymer Chemistry*, Vol. 29, 1667–1674 (1991), U.S. Pat. Nos. 5,066,811 (Nov. 1991) and 5,116,934 (May 1992). These patents are incorporated in their entirety by reference herein. Thin films of PAEIs are prepared by solution casting in a dust-free environment with subsequent removal of the solvent by heating in a forced air oven.

It is a primary object of the present invention to use films of PAEIs as surface modifiers for flat and parabolic panels made of neat resin epoxy or neat resin bismaleimide, as well as panels made of composites of epoxies or bismaleimides which may contain any type of continuous or chopped fiber or fabric.

Another object of this invention is to provide submicron surface smoothness to panels of neat resin epoxy and/or bismaleimide and composites of epoxies and/or bismaleimides which may contain any type of continuous or chopped fiber or fabric.

Another object of this invention is to eliminate the need for mold release agents when processing neat resin epoxy and/or bismaleimide and composites of epoxies and/or bismaleimides which may contain any type of continuous or chopped fiber or fabric.

Another object of this invention is to eliminate the need for postmachining or polishing of parts processed from neat resin epoxy and/or bismaleimide and composites of epoxies and/or bismaleimides which may contain any type of continuous or chopped fiber or fabric.

Another object of this invention is to provide a method of preparing precision composite reflectors using carbon/graphite epoxy.

SUMMARY OF THE INVENTION

According to the present invention, thin films of thermoplastic poly(arylene ether imidazole)s (PAEI)s have been found to be particularly suitable for use as surface modifiers for neat resin epoxy or neat resin bismaleimide panels, as well as for graphite/epoxy or graphite/bismaleimide composite panels. A molecule of PAEI includes imidazole groups along its backbone that co-cure, i.e., react chemically, with epoxies or bismaleimides during processing. This co-curing provides excellent adhesion between PAEI films and the neat resin epoxy or bismaleimide, as well as the graphite/epoxy or graphite/bismaleimide structures.

A PAEI film is applied to such a structure during processing in a smooth mold, with the result that the as-processed structure has a smooth (specular) surface. Thus, there is no need for postmachining or polishing of PAEI-processed parts made of neat-resin epoxies and/or bismaleimides, or made of composites of epoxies and/or bismaleimides that may contain any type of continuous or chopped fibers or fabrics. Additionally, PAEI films are readily released from smooth glass or stainless-steel molds, so that no release agent is necessary. The adhesion between the PAEI films and the neat resin or composite structure remains even after thermal cycling from room temperature to about −196° C. PAEI films are thermally stable and resistant to bombardment by energetic electrons.

BRIEF DESCRIPTION OF THE DRAWINGS

For a more complete understanding of the present invention, including its objects and attending benefits, reference should be made to the Description of the Preferred Embodiments, which is set forth in detail below. This Description should be read together with the accompanying drawings wherein.

According to the present invention, a graphite/epoxy composite parabolic panel with the PAEI film as a surface modifier was fabricated. The as-processed panel had an areal weight of 5.7 kg/m$^2$ and a surface smoothness of 1.8 μm root mean square (RMS), both easily meeting goals of 10 kg/m$^2$ and 3.0 μm RMS. The panel surface was highly specular and exhibited a mirror-like finish when coated with vapor deposited aluminum and silicon oxide. The use of the PAEI film eliminated fiber print through, post-polishing and use of mold release agents, which can contaminate the panel surface and contribute to surface roughness. The PAEI film is thermally stable, resistant to electron radiation, and adheres tenaciously to the facesheet even when thermally cycled. The imidazole groups on the surface of the polymer film react chemically (co-cure) with the epoxy or bismaleimide and thereby provide excellent adhesion. Films of this type are used to provide stable precision surfaces on a variety of graphite/epoxy or graphite/bismaleimide structures.

Having generally described the invention, a more complete understanding thereof can be obtained by reference to the following specific Examples, which are provided herein for the purpose of illustration only and do not limit the invention.

EXAMPLE 1

The following example illustrates the use of a PAEI thermoplastic film in the manufacture of a precision composite reflector panel.

Figure 1:
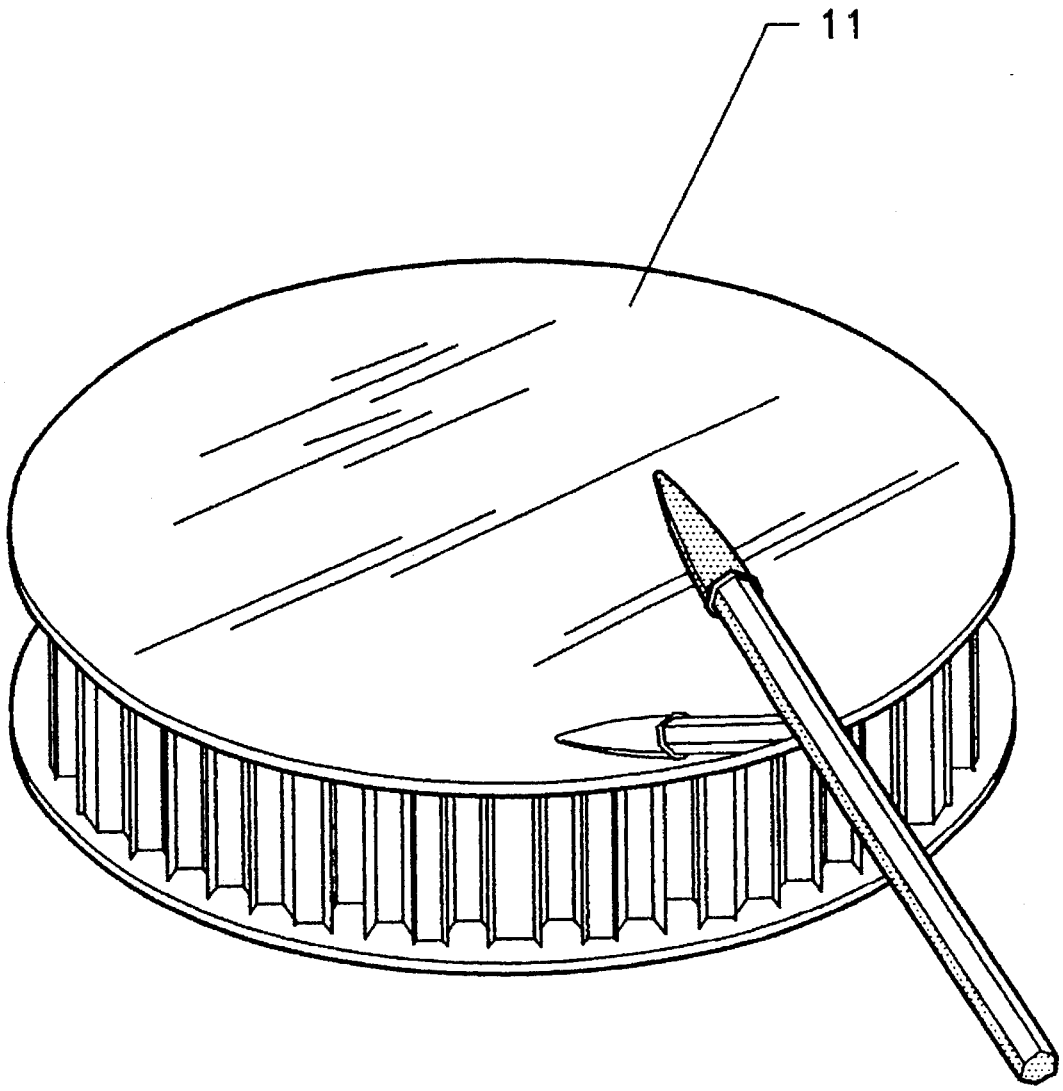
FIG. 1 shows a composite structure according to the present invention comprising a poly(arylene ether imidazole) surfacing film upon which a reflective layer of aluminum followed by silicon oxide has been vapor deposited.

A 50 μm thick PAEI film was placed directly against a precision convex parabolic glass tool 36 cm in diameter. The perimeter of the film was affixed to the glass tool using double-sided adhesive tape. A 25 cm diameter, uncured eight ply quasi-isotropic prepreg tape lay-up composed of T50 carbon fiber with ERL-1962 epoxy resin was placed on top of the PAEI film and glass tool. The entire tool and lay-up were vacuum bagged and heated to 177° C. under 0.7 MPa pressure in an autoclave causing the epoxy to cure and chemically bond to the surface of the PAEI film. The cured composite laminate and tool were removed from the autoclave. A 5 cm thick, graphite/phenolic composite honeycomb core material and a T50/ERL-1962 composite facesheet were adhesively bonded to the back of the laminate (the side without the PAEI film). After the adhesive cured, the entire sandwich was lifted from the glass tool and the excess PAEI film was trimmed from the edge of the panel. The resulting panel possessed a precision concave parabolic contour with the PAEI film bonded to the surface providing a "glass-like" finish. The final reflector surface 11, as shown in FIG. 1, was produced by vapor depositing a reflective layer, consisting of 500 Å, of aluminum followed by 500 Å of silicon oxide, directly to the surface of the PAEI without any pretreatment or polishing. The surface accuracy of the reflector surface was tested with an infrared laser interferometer and was measured to be 1.8 μm RMS over the entire 25 cm diameter. The parabolic composite reflector had an areal weight of 5.7 kg/m$^2$.

EXAMPLE 2

The following example illustrates the use of PAEI thermoplastic film in the manufacture of a precision composite reflector panel.

A 100 μm thick PAEI film was placed against a precision convex parabolic stainless steel tool 36 cm in diameter, covered with a release film. A 36 cm diameter, uncured eight ply quasi-isotropic prepreg tape lay-up composed of P75 carbon fiber with 930 epoxy resin was placed on top of the PAEI film and steel tool. The entire tool and lay-up were vacuum bagged and heated to 135° C. under 0.7 MPa pressure in an autoclave causing the epoxy to cure and chemically bond to the surface of the PAEI film. The cured composite laminate and tool were removed from the autoclave. A 5 cm thick, graphite/phenolic composite honeycomb core material and a P75/930 composite facesheet were adhesively bonded to the back of the laminate (the side without the PAEI film). After the adhesive cured, the entire sandwich was lifted from the steel tool and the excess PAEI film was trimmed from the edge of the panel. The resulting panel possessed a precision concave parabolic contour with the PAEI film bonded to the surface providing a "glass-like" finish. The final reflector surface was produced by vapor depositing a reflective layer, consisting of 500 Å of aluminum followed by 500 Å of silicon oxide, directly to the surface of the PAEI without any pretreatment or polishing.

EXAMPLE 3

The following example illustrates the use of PAEI thermoplastic film in the manufacture of a composite reflector panel.

A 18 cm×18 cm, 75 μm thick PAEI film was placed directly against a stainless steel ferrotype plate. The edges of the film were taped to the steel plate. A 15 cm×15 cm, uncured eight ply quasi-isotropic prepreg tape lay-up composed of P75 carbon fiber with 930 epoxy resin was placed on top of the PAEI film. The entire steel plate and lay-up were vacuum bagged and heated to 135° C. under 0.7 MPa pressure in an autoclave causing the epoxy to cure and chemically bond to the surface of the PAEI film. The cured composite laminate was easily released from the steel plate by removing the adhesive tape. A 3 cm thick, glass/polyimide composite honeycomb core material and a P75/930 composite facesheet were adhesively bonded to the back of the laminate (the side without the PAEI film). After the adhesive cured, the entire sandwich was lifted from the steel tool and the excess PAEI film was trimmed from the edge of the panel. The resulting panel had PAEI film bonded to one surface providing a "glass-like" finish. A mirrored finish was produced by vapor depositing 500 Å of aluminum directly to the PAEI.

EXAMPLE 4

The following example illustrates the strength and durability of the bond between PAEI film and a graphite/epoxy composite laminate after thermal cycling.

A 18 cm×18 cm, 50 μm thick PAEI film was placed directly against a flat polished glass tool. The edges of the film were taped to the glass tool. A 15 cm×15 cm, uncured eight ply quasi-isotropic prepreg tape lay-up composed of P75 carbon fiber with 930 epoxy resin was placed on top of the PAEI film. The entire glass tool and lay-up were vacuum bagged and heated to 135° C. under 0.7 MPa pressure in an autoclave causing the epoxy to cure and chemically bond to the surface of the PAEI film. The cured composite laminate was easily released from the glass tool by removing the adhesive tape. The resulting composite laminate had the PAEI film bonded to one side. The laminate was cut into five 2.5 cm×15 cm test strips. One of the test strips was quenched in liquid nitrogen from room temperature. The sample was removed from the liquid nitrogen and allowed to heat back to room temperature, then quenched again in the liquid nitrogen. This procedure was repeated for a total of five quenching. No deterioration of the bond between the PAEI film and the composite could be detected. All attempts to remove the PAEI film from the composite resulted in either the epoxy failing at the surface of the composite or the PAEI tearing through the thickness of the film. Attempts to remove the film from the composite included trying to peal off the film from a corner, fracturing the composite in a flexural mode so as to leave the two fractured pieces connected by the PAEI film followed by an attempted peal, and scribing across the surface of the PAEI film with a steel scribe. Failure at the PAEI/composite interface was not observed in any of these tests. Samples which had not been thermally cycled behaved in a similar manner.

EXAMPLE 5

The following example illustrates the strength and durability of the bond between PAEI film and a graphite/epoxy composite laminate after thermal cycling.

A 15 cm×15 cm, 50 μm thick PAEI film was placed between the 11th and 12th plies of a 15 cm×15 cm, twenty-two ply unidirectional composite prepreg lay-up composed of P75 carbon fiber with 934 epoxy resin. A release agent had been applied to one end of the film over an area 6.3 cm in from the edge across the 15 cm width. The composite laminate was heated to 177° C. under 0.7 MPa pressure in an autoclave causing the epoxy to cure and chemically bond to either side of the PAEI film except where the release agent had been applied. The cured laminate was cut into five 2.5 cm×15 cm test strips. Two of the test strips were quenched in liquid nitrogen from room temperature. The sample was removed from the liquid nitrogen and allowed to heat back to room temperature then quenched again in the liquid nitrogen. This procedure was repeated for a total of three quenching. The test samples were pealed apart along the fiber direction between the 11th and 12th plies. The portion of the film where the release agent had been applied did not bond to the composite and served as an initial crack through which the peal could be started. Failure at the PAEI/composite interface was observed only where release agent had been applied. In all other regions, failure had occurred entirely in the composite leaving thin layer of carbon fibers and epoxy bonded to the PAEI film. This indicated the presence of a very strong adhesive bond between the PAEI and composite. Samples which had not been thermally cycled behaved in a similar manner.

Figure 2:
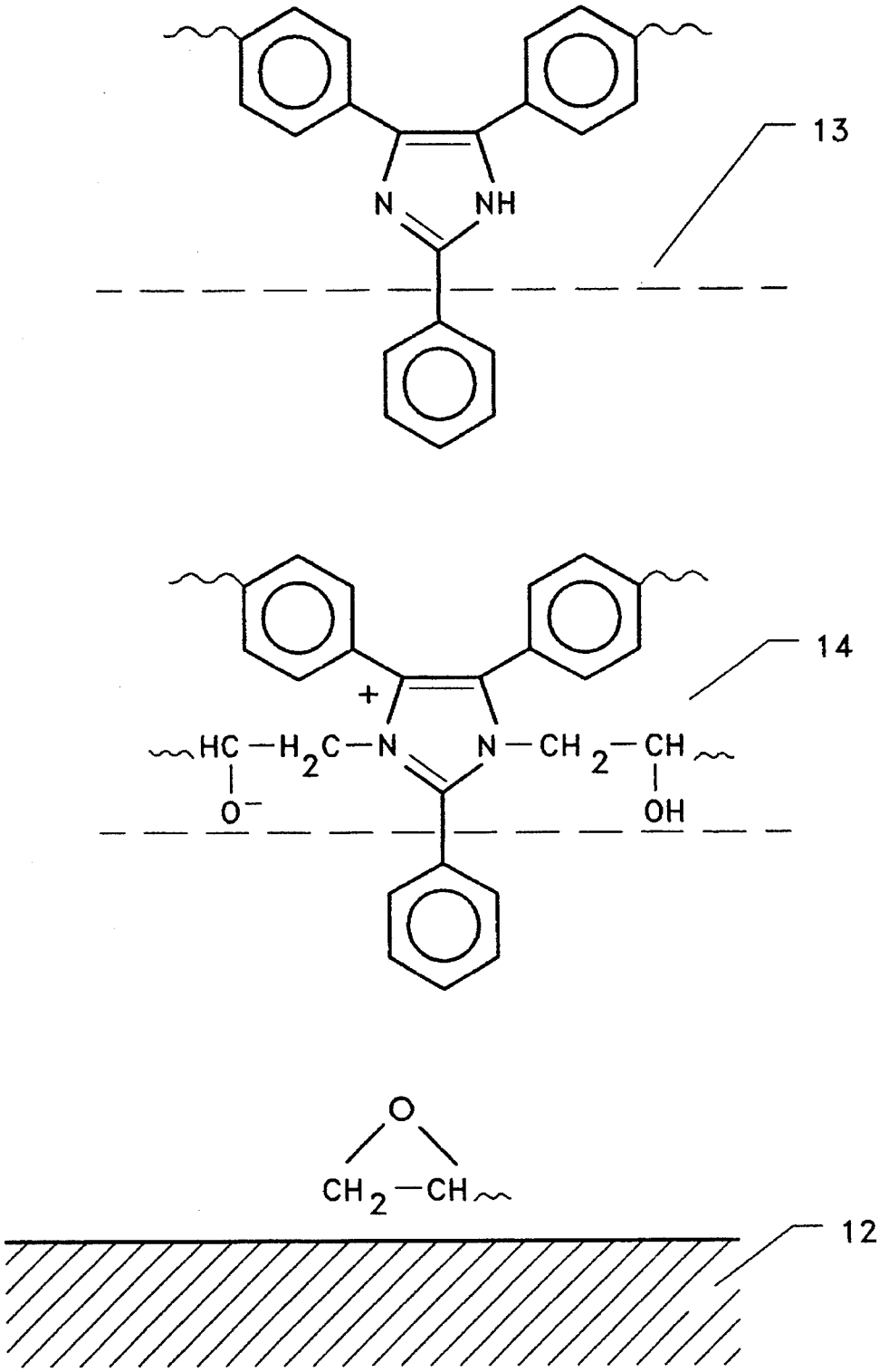
FIG. 2 is a representation of the interface between a graphite/epoxy facesheet and a poly(arylene ether imidazole) surfacing film according to the present invention.

A representation of the observed interface 14 between the graphite/epoxy facesheet 12 and the PAEI film 13 is presented in FIG. 2.

FIG. 2 shows a chemical reaction between the epoxy 12 and the PAEI film 13 which provides a more stable interface 14 than one based upon secondary adhesive forces which occur when nonreactive films, such as Kapton®, are used. The interface 14 formed between the epoxy and the PAEI film provides for better thermal cycling behavior since a gradient is formed between the two layers which presumably has a different coefficient of thermal expansion (CTE) than either the PAEI film or the epoxy. Nonreactive films such as Kapton® can disbond after prolonged thermal cycling due to stresses which accumulate caused by the mismatch in CTE between the epoxy and the film.

We claim:

1. An integral structure comprising a surfacing film of a thermoplastic poly(arylene ether imidazole) chemically bonded (co-cured) to a member selected from the group consisting of neat epoxy or bismaleimide resin panels and composite epoxy or bismaleimide resin panels wherein the thermoplastic poly(arylene ether imidazole) is prepared by reacting a di(hydroxyphenyl)imidazole and an activated aromatic dihalide or dinitro compound having the general structure:

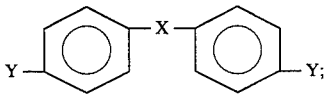

wherein X is a radical selected from the group consisting of:

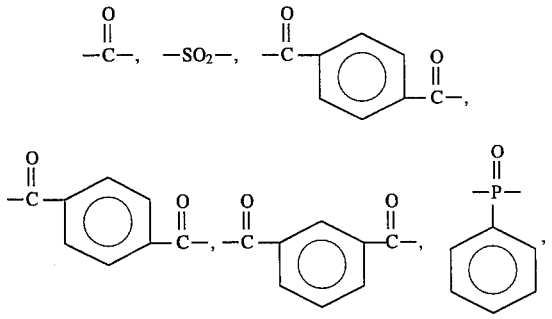

-continued

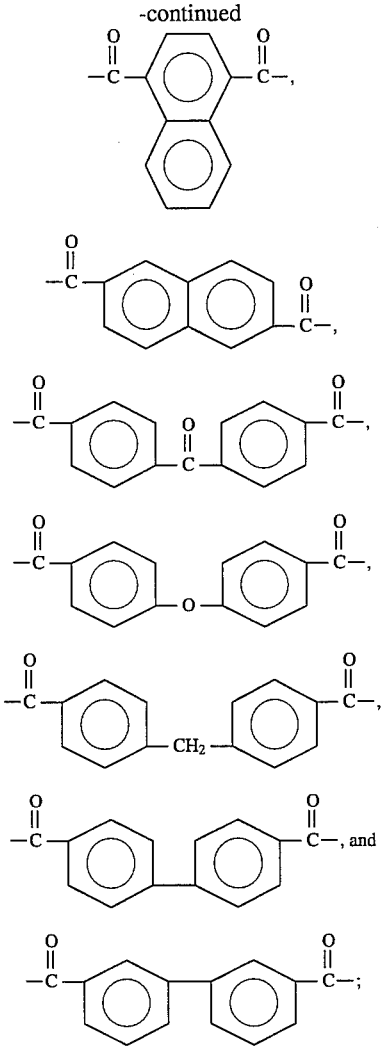

wherein Y is selected from the group consisting of: Cl, F and $NO_2$; wherein said reaction is carried out in a polar aprotic solvent selected from the group consisting of: N,N-dimethylacetamide, N-methylpyrrolidinone, sulfolane, diphenylsulfone, N-cyclohexylpyrrolidinone, and dimethylsulfoxide; wherein said reaction is carried out in the presence of an alkali metal base; and wherein said reaction is carried out with the application of heat.

2. The integral structure of claim 1, wherein said panel is a neat resin panel and is selected from the group consisting of epoxy resin panels and bismaleimide resin panels, which are paraboloidal in shape.

3. The integral structure of claim 1, wherein said panel is a composite resin panel and is selected from the group consisting of carbon or graphite/epoxy composites and carbon or graphite/bismaleimide composites, which are paraboloidal in shape.

4. The integral structure of claim 1, which is paraboloidal in shape.

5. A parabolic reflector comprising a paraboloidal composite resin panel of carbon fiber/epoxy which is chemically bonded (co-cured) to a surfacing film of a thermoplastic poly(arylene ether imidazole), the exposed surface of the surfacing film having a reflective layer of aluminum vapor deposited thereon, followed by a layer of silicon oxide vapor deposited thereon, and wherein the thermoplastic poly(arylene ether imidazole) is prepared by reacting a di(hydroxyphenyl)imidazole and an activated aromatic dihalide or dinitro compound having the general structure:

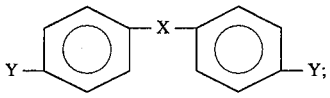

wherein X is a radical selected from the group consisting of:

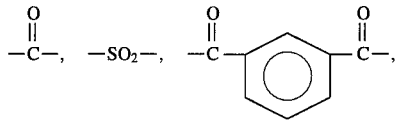

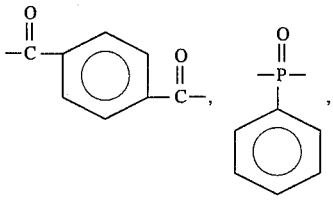

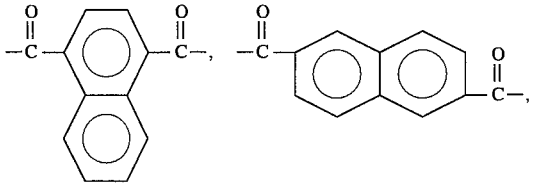

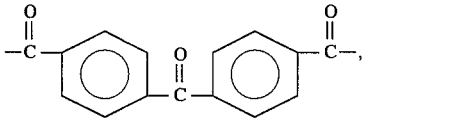

-continued

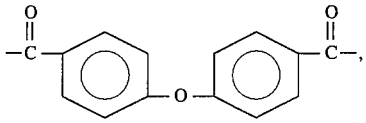

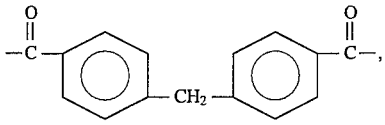

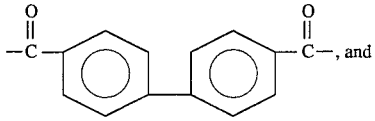

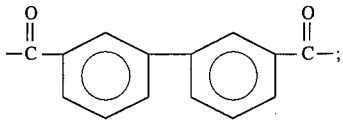

wherein Y is selected from the group consisting of: Cl, F and $NO_2$; wherein said reaction is carried out in a polar aprotic solvent selected from the group consisting of: N,N-dimethylacetamide, N-methylpyrrolidinone, sulfolane, diphenylsulfone, N-cyclohexylpyrrolidinone, and dimethylsulfoxide; wherein said reaction is carried out in the presence of an alkali metal base; and wherein said reaction is carried out with the application of heat.

* * * * *